United States Patent [19]

Terrenzio

[11] Patent Number: 4,796,822

[45] Date of Patent: Jan. 10, 1989

[54] IMPELLER FOR AN IMPACT CRUSHER

[75] Inventor: Gabriel M. Terrenzio, Seattle, Wash.

[73] Assignee: Acrowood Corporation, Everett, Wash.

[21] Appl. No.: 23,925

[22] Filed: Mar. 9, 1987

Related U.S. Application Data

[63] Continuation of Ser. No. 774,669, Sep. 11, 1985, abandoned, which is a continuation-in-part of Ser. No. 553,222, Nov. 18, 1983, Pat. No. 4,577,806.

[51] Int. Cl.[4] ..... B02C 19/00

[52] U.S. Cl. ..... 241/275

[58] Field of Search ..... 241/275

[56] References Cited

U.S. PATENT DOCUMENTS

| | | | |
|---|---|---|---|
| 2,992,784 | 7/1961 | Behnke et al. | 241/275 |
| 3,258,211 | 6/1966 | Behnke | 241/275 |
| 3,955,767 | 5/1976 | Hise | 241/275 |
| 4,090,673 | 5/1978 | Ackers et al. | 241/275 |
| 4,166,585 | 9/1979 | Alford et al. | 241/275 |
| 4,390,136 | 6/1983 | Burk | 241/275 |

*Primary Examiner*—P. W. Echols
*Assistant Examiner*—Joseph M. Gorski
*Attorney, Agent, or Firm*—Seed and Berry

[57] ABSTRACT

An impeller is disclosed for use in a centrifugal impact rock crusher. The crusher includes a cylindrical housing and an impact surface positioned radially around the housing interior. The impeller, which is mounted for concentric rotation within the housing, includes upper and lower cover plates, a landing surface being carried upon the lower plate and an opening being formed in the upper plate for directing rock into the impeller. A cylindrical sidewall connects the cover plates and has a plurality of exit openings formed equally spaced around the sidewall. Rotation of the impeller causes a portion of the rock to be crushed to be retained with the impeller by lips and baffles mounted therein, the retained rock forming accumulations having relatively well-defined faces. A plurality of wear plates are carried on the upper and lower cover plates, each wear plate having a recess formed in its surface along the intersection of one face with the wear plate and extending away from the accumulation along at least a portion of the accumulation face. The recess retains rock therein to protect the wear plate surface from abrasion by rock thrown from the impeller.

14 Claims, 5 Drawing Sheets

FIG. 2
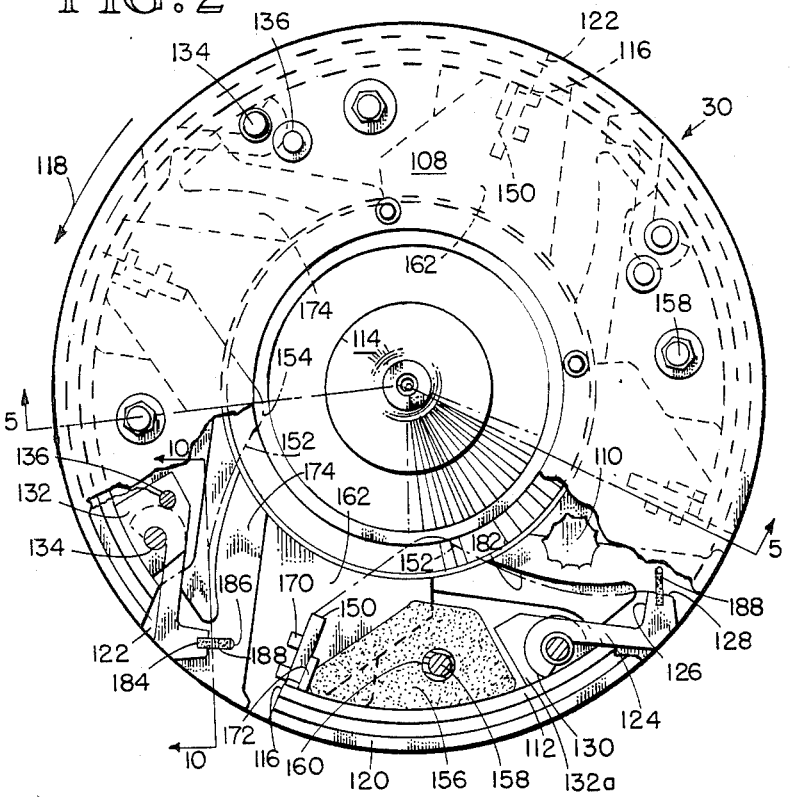
FIG. 3
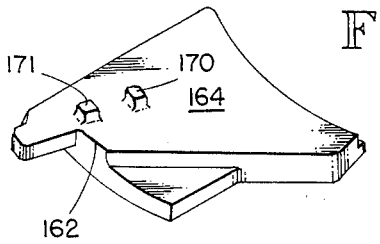
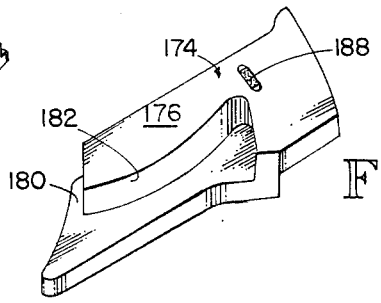
FIG. 4

FIG.6
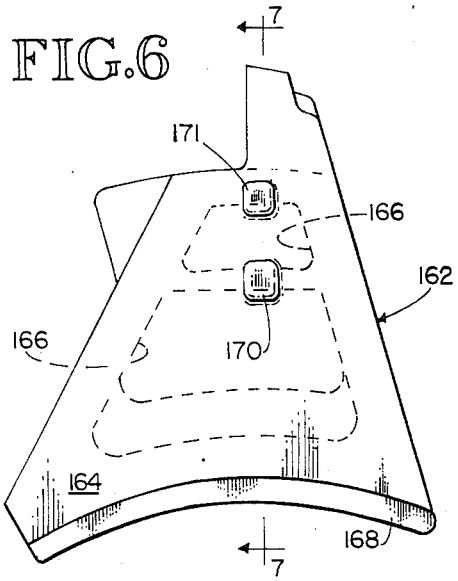
FIG.7
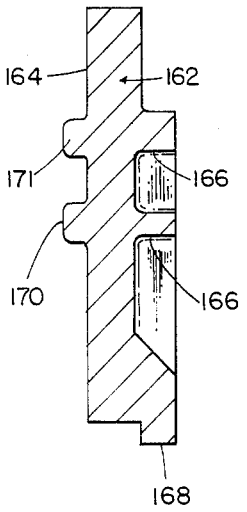
FIG.8
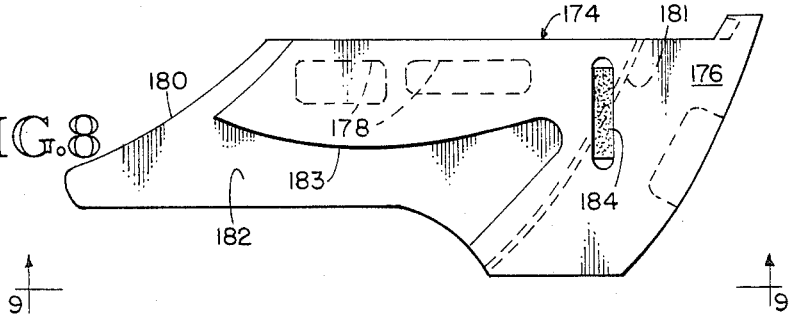
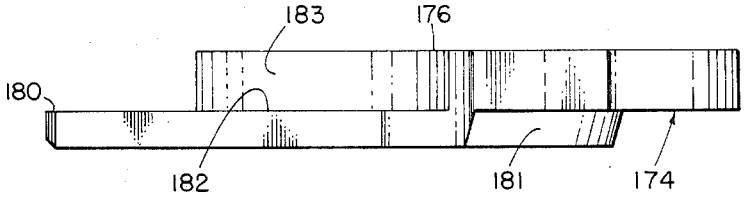
FIG.9

IMPELLER FOR AN IMPACT CRUSHER

CROSS-REFERENCE TO RELATED APPLICATION

This application is a continuation of U.S. patent application Ser. No. 774,669, filed Sept. 11, 1986, now abandoned under C.F.R. §1.62 which is a continuation-in-part of my copending application Ser. No. 553,222, filed Nov. 18, 1983, now U.S. Pat. No. 4,577,806, issued Mar. 25, 1986.

1. Technical Field

The present invention relates to impact-type crushers and, more particularly, to those which utilize centrifugal force to hurl the rock to be crushed against an impact surface.

2. Background Art

Impact-type crushers utilizing centrifugal force to hurl rocks to be crushed are generally known. For example in U.S. Pat. No. 4,126,280, issued Nov. 21, 1978 to Burk, rock is fed into a rotating impeller disposed in a cylindrical housing. The impeller throws the rock against a plurality of crushing anvils arranged in a ring concentric with the axis of rotation of the impeller. As another approach, in U.S. Pat. No. 3,970,257, issued July 20, 1976 to MacDonald et al., a rotating impeller throws the rock against a bed of crushed rock instead of the anvils. In either case, a primary design consideration is providing for a sufficient useful life span of the apparatus, particularly those portions of the apparatus which come into contact with the rock as it is hurled. For example, portions of the device, such as impeller vanes and upper and lower plates within the impeller, are subject to a great deal of wear while they are accelerating the rock. As a result, any portions of the apparatus subject to wear require periodic and relatively frequent replacement, which necessitates substantial down time for the equipment and incurs considerable cost for replacement of worn parts.

Various improvements are known that, when incorporated into a crusher, can protect certain portions of the apparatus and reduce wear. For example, in the MacDonald et al. patent, the use of a crushed rock bed as the impact surface eliminates problems of wear on anvil surfaces such as are present in the Burk device. In addition, within the impeller, the MacDonald et al. device utilizes various walls to create a plurality of pockets for trapping a portion of the rock within the impeller. These accumulations of rock then define the sidewall along which the material is generally accelerated, protecting these portions of the impeller from wear.

While such an approach provides protection for the sidewalls surface within the impeller, it does not preclude wear along the upper and lower impeller surfaces. Most of the rock traverses the faces of the rock accumulations as it is thrown from the impeller, but a not insubstantial portion of the rock moves along the upper and lower edges of the rock faces and along the upper and lower impeller surfaces near the accumulations. Typically, wear plates are installed along these surfaces so that these plates, rather than the integral structure of the impeller, will be worn. While this is helpful in protecting the impeller, it nonetheless still requires frequent and periodic replacement of the wear plates, with the attendant loss in productivity and expense for replacement parts.

What is needed, therefore, is an impeller structure that provides protection not only for the sidewalls of the impeller, but also for the upper and lower impeller surfaces in the vicinity of the rock accumulations defining the sidewalls. Such protection should not, of course, affect the overall design of the rock crusher or the operation characteristics of the impeller, and should be reliable and of relatively inexpensive construction.

DISCLOSURE OF INVENTION

The present invention provides an improved impeller for use in a centrifugal impact rock crusher, the crusher having a cylindrical housing with a vertically disposed central axis. An impact surface is positioned radially around the interior of the housing and is transverse to the central axis. The impeller is concentrically mounted within the housing and is rotatable about the axis. Means for feeding rock to be crushed to the impeller is provided.

The impeller includes upper and lower cover plates, the lower cover plate being connected to the impeller mounting means and the upper cover plate defining an opening concentric with the axis for receiving rock to be crushed into the impeller. Means defining a landing surface is carried upon the lower cover plate concentrically with the axis for impingement thereon of rock being fed to the impeller. A generally cylindrical sidewall connects the upper and lower cover plates and defines therein a plurality of exit openings in an equally spaced relationship along the sidewall. Each of the openings is formed having two opposing side edges.

Connected to at least one of the cover plates in the sidewall, and adjacent to one of the side edges of each of the openings, is means for retaining a portion of rock to be crushed within the impeller in response to rotation of the impeller. The retaining means creates an accumulation of such rock at each of the openings, with each accumulation including a relatively well-defined face. Rotation of the impeller causes rock to be crushed to move generally along the faces of the accumulations as the rock is thrown through the openings.

A plurality of wear plates are carried on the upper and lower cover plates, with each of the wear plates having a surface. Each plate is connectd to one of the cover plates such that one of the faces of the accumulations intersects the wear plate. The wear plate defines a recess along the intersection with the accumulation face that extends into the surface and away from the accumulation along at least a portion of the face. The recess retains therein a portion of rock to be crushed, and serves to protect the portion of the wear plate closest to the accumulation face in that rock being thrown from the impeller moves along the rock held within the recess rather than along the surface of the wear plate.

Accordingly, it is an object of the present invention to provide an improved impeller for use within a centrifugal impact-type rock crusher that significantly reduces wear within the impeller assembly; to provide such an impeller that can be operated for long periods of time without requiring replacement of impeller parts; to provide such an impeller in which parts which do require replacement due to wear do not form a portion of the integral impeller structure; and to provide such an impeller in which such parts are easily removable and replaceable.

Other objects and advantages of the present invention will be apparent from the following description, the accompanying drawings, and the appended claims.

BRIEF DESCRIPTION OF THE DRAWINGS

FIG. 2 is a top plan view of an impeller assembly according to the present invention with a portion of the upper plate thereof removed;

FIG. 3 is a perspective view of a wear plate used within the impeller assembly of FIG. 2;

FIG. 4 is a perspective view of a second wear plate used within the impeller assembly;

FIG. 6 is a plan view of the wear plate shown in FIG. 3;

FIG. 7 is a sectional view taken generally along line 7—7 of FIG. 6;

FIG. 8 is a plan view of the wear plate shown in FIG. 4;

FIG. 9 is a view taken generally along line 9—9 of FIG. 8; and

BEST MODE FOR CARRYING OUT THE INVENTION

Figure 1:
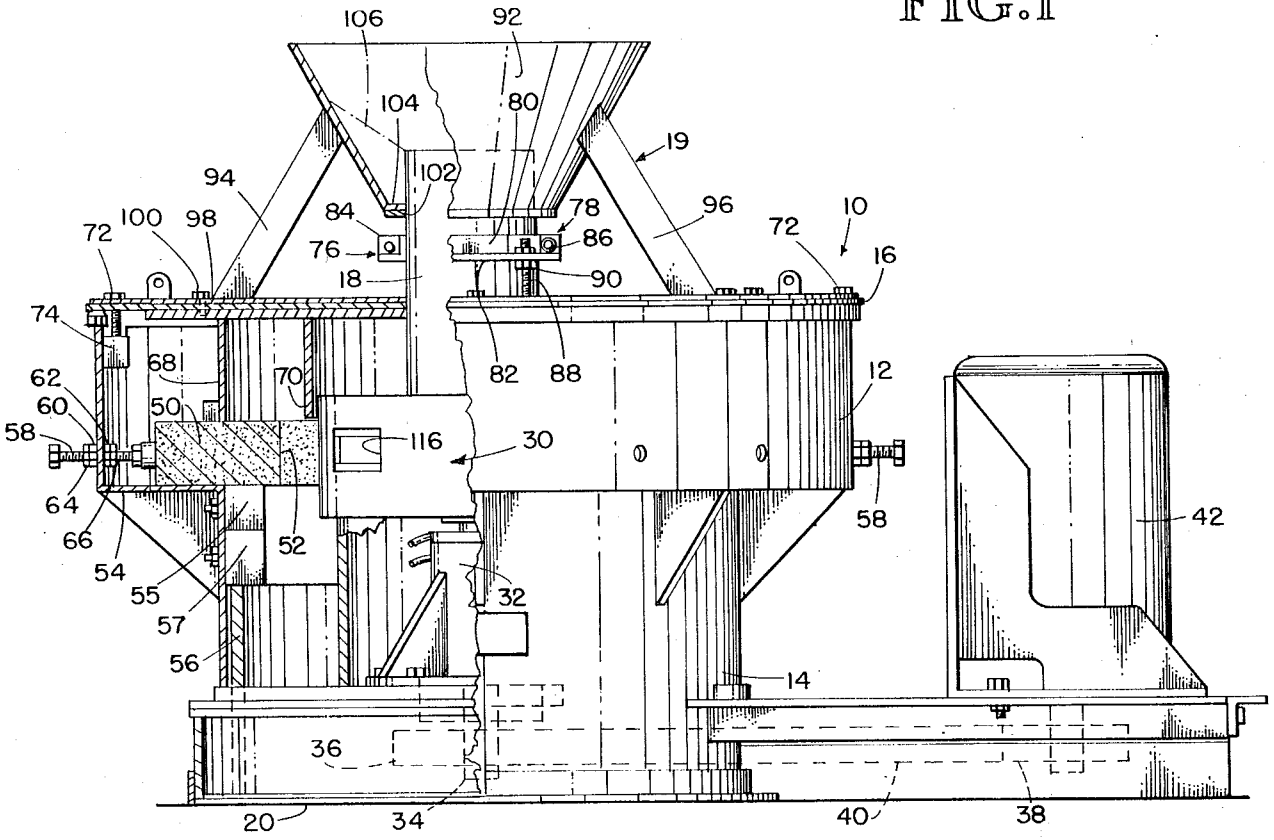
FIG. 1 is an elevational view in partial cross-section of a crusher with which the impeller assembly of the present invention may be used.

As illustrated in FIG. 1, the rock crusher with which the impeller of the present invention is used includes a cylindrical housing 10 with concentric upper and lower portions 12 and 14. While the term "rock crusher" of course indicates apparatus for crushing rock, it should be recognized that a rock crusher of the type shown is equally capable of crushing glass, brick, concrete, asphaltic pavement material, and other rock-like material.

Upper portion 12 is of somewhat larger diameter than lower portion 14 and is provided with a top cover plate 16 through which passes a central cylindrical feed tube 18. Feed tube 18 represents one portion of feed means 19 which directs rock to be crushed into the apparatus. The smaller diameter lower portion 14 of housing 10 is open at the bottom 20 in order to permit rock to be discharged from the apparatus once it has been crushed. The cylindrical housing 10 is usually positioned on top of a framework (not shown) which permits the rock to fall from the open bottom 20.

Disposed concentrically within housing 10 beneath the feed tube 18 is the impeller assembly 30, which is mounted for rotation in bearing support member 32. The impeller assembly 30 is driven by a central drive shaft 34 having one end extending down through bearing support member 32 into the lower portion of housing 10, where it is connected by pulleys 36 and 38 and V-belt 40 to the drive motor 42. Motor 42 thus rotates impeller assembly 30 at typical peripheral speeds for the assembly 30 in the range of 3,500 to 20,000 feet per minute. As a result, considerable centrifugal force is generated within the impeller assembly 30.

Disposed concentrically around the impeller assembly 30 within the upper portion 12 of housing 10 is a plurality of adjustably positioned anvils 50. The anvils are disposed so that their end faces 52 form a generally cylindrical impact surface around the impeller assembly 30 against which the rock to be crushed is centrifugally thrown by the impeller assembly.

Each anvil 50 is supported by a shelf ring 54, and a cylindrical liner member 56 is positioned within the lower housing portion 14 to protect the wall of housing portion 14 from wear. In addition, rows of fixed anvils 55 and 47 are mounted to the inner wall of lower housing 14, providing further protection for housing 10 and partially supporting anvils 50.

A threaded bolt 58 is secured to the rear portion of the body of each anvil 50 and extends through a corresponding hole in the wall of upper portion 12. Inner and outer nuts 60 and 62 threadably engage the bolt 58 on each side of the wall of upper portion 12 in order to position each anvil 50 in a desired radial location and hold the anvil in that position. Passage of bolt 58 through the wall of upper portion 12 enables bolt 58 to be used in adjusting its corresponding anvil 50 inwardly as the end face 52 of the anvil wears. Nuts 60 and 62 are in turn secured by jam nuts 64 and 66, respectively.

A removable ring 68 is placed atop the anvils 50 within upper housing portion 12. Ring 68, when secured in place by fastening the cover 16 to the upper housing portion 12, secures anvils 50 from any vertical movement during operation of the crusher. In addition, ring 68 serves to prevent rock from rebounding from end faces 52 of anvils 50 to the area behind the anvils. Similarly, ring 70, which is attached to the interior of cover 16, prevents rebounding rock from entering the area above impeller assembly 30.

Cover plate 16 is secured to the upper housing portion 12 by a plurality of bolts 72 which pass through cover plate 16 and engage with threaded mounting blocks 74 secured to the inside surface of the wall of housing portion 12.

As an alternative configuration for the rock crusher, the impact surface may be formed from a bed of crushed rock rather than the end faces of a plurality of anvils. In such a case, the crusher housing 10 is quite similar to that shown in FIG. 1, with the exception that the anvils 50 and their associated mounting means are removed. A shelf extension may be formed inwardly from shelf ring 54 and may include an annular flange extending slightly upward form the inner edge of the extension surface.

During operation of the rock crusher, rock is retained within upper housing portion 12 along shelf 54 and the shelf extension by the annular flange. The accumulated rock assumes a configuration defining an impact surface, and rock to be crushed is thrown by the impeller assembly 30 onto the rock bed. The crushed rock then drops through lower housing portion 14.

Greater detail with respect to a rock crusher of this type may be seen by reference to my copending U.S. patent application Ser. No. 553,350, filed Nov. 18, 1983. This application, entitled "Convertible Centrifugal Rock Crusher," describes a crusher that is adapted to be convertible from a rock crusher utilizing a rock bed to form the impact surface to one utilizing a plurality of anvils, and vice versa.

Feed means 19 includes feed tube 18, which has secured about it clamp halves 76 and 78. Clamp halves 76 and 78 are each identical and include a semicylindrical flange 80 which is placed in contact with feed tube 18 and a horizontal flange 82 extending radially outwardly from semicylindrical flange 80. Vertical radial flange 84 are mounted at each end of clamp halves 76 and 78, and are disposed perpendicularly with respect to both semicylindrical flanges 80 and horizontal flanges 82. Bolt 86 extends through each cooperating pair of vertical flanges 84 to secure clamp halves 76 and 78 about the tube 18.

A plurality of holes are formed through each horizontal flange 82. Threaded studs 88, which are fastened in upright fashion to cover plate 16, are placed through the holes formed in radial flanges 82. A pair of nuts 90 are placed on each stud 88, on opposite sides of radial flange 82, to secure feed tube 18 with respect to crusher housing 10.

Feed means 19 further includes a hopper 92 which has a pair of legs 94 and 96 extending downwardly from each side of hopper 92. Legs 94 and 96 terminate at mounting pads 98, which are in turn secured to cover plate 16 by bolts 100 or the like.

An annular bottom plate 102 is secured to the lower end of hopper 92. Bottom plate 102 includes a central opening 104 which is of slightly greater diameter than that of feed tube 18. Feed tube 18 extends through opening 104 into the interior of hopper 92 to a height substantially above bottom plate 102. Thus, as rock is fed into the crushing apparatus, a portion of the rock will be retained within hopper 92 in the portion thereof around the exterior of feed tube 18, indicated generally at 106. Thus, wear on the inside surface of hopper 92 as rock is placed therein is prevented by the rock retained within hopper 92.

Additionally, since feed tube 18 is not attached to either hopper 92 or bottom plate 102, the vertical positioning of feed tube 18 with respect to crusher housing 10 may be adjusted over small distance by movement of nuts 90 along each of studs the 88. For vertical movement of feed tube 18 over larger distances, bolts 86 may be loosened, thereby releasing feed tube 18 from within clamp halves 76 and 78. Upon movement to a new position, bolts 86 are retightened. Thus, as the lower end of feed tube 18 is worn, as will be explained in detail below, feed tube 18 may be adjusted downwardly to provide greater time periods between complete replacement of feed tube 18.

Further, attachment of feed tube 18 by clamp halves 76 and 78 enables feed tubes 18 to be removed for replacement by simply releasing clamp halves 76 and 78 from around the tube. The tube is then pulled upwardly through hopper 92, avoiding removal of the hopper structure as has been required in previous crushers.

Figure 5:
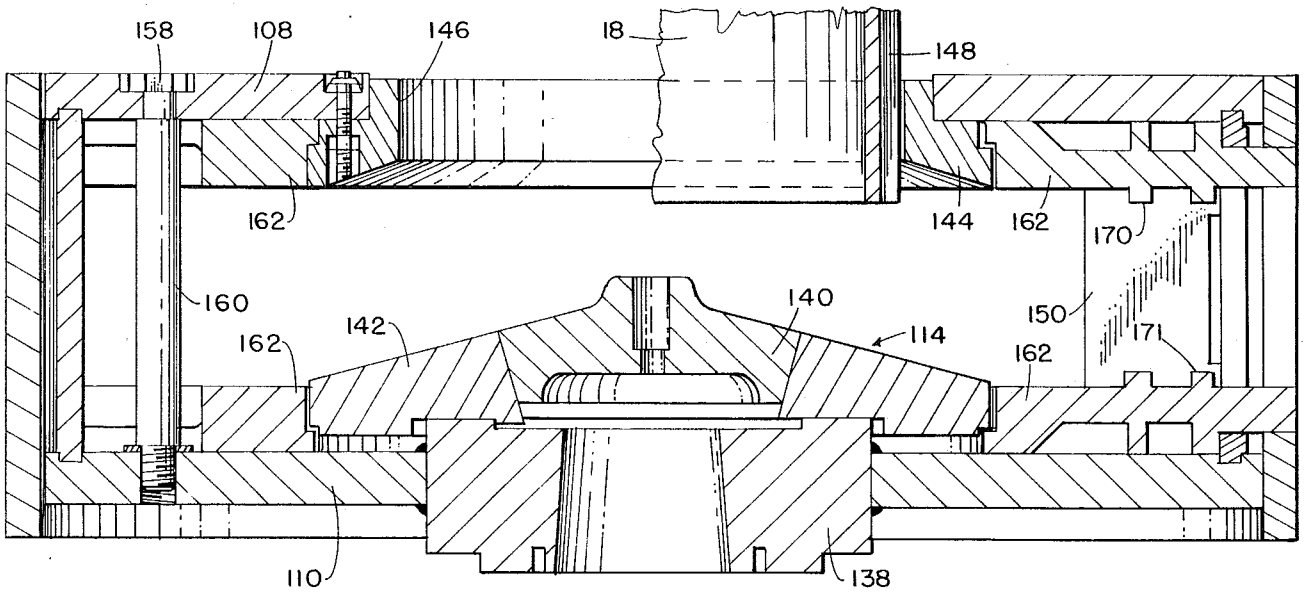
FIG. 5 is a sectional view taken generally along line 5—5 of FIG. 2.
Figure 10:
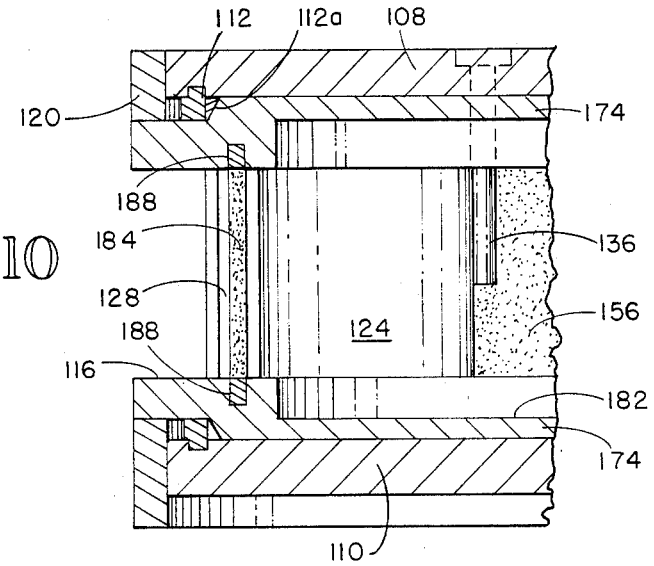
FIG. 10 is a sectional view taken generally along line 10—10 of FIG. 2.

The impeller assembly 30 may be seen in detail in FIGS. 2, 5 and 10. As shown in FIG. 2, the impeller assembly 30 includes an upper plate 108, a lower plate 110, and a generally cylindrical sidewall 112 connected therebetween. The upper plate 108 may be provided with a replacement wear plate (not shown). A landing surface 114 is carried on lower plate 110, upon which rock fed into the impeller assembly 30 through feed tube 18 impinges. A plurality of exit openings 116 are formed through sidewall 112, spaced equidistantly therearound. Thus, as impeller 30 is rotated in the direction indicated by arrow 118, rock impinging upon landing surface 114 will be thrown from the impeller assembly through exit openings 116. A wear ring 120 surrounds sidewall 112 and is provided with a number of openings 122 equal to the number of exit openings 116, with openings 122 being coincident with exit openings 116.

It will be recognized that, although four exit openings 116 are shown, as few as two openings may be provided, with the upper limit being determined by the size of the impeller assembly and the desired production rate of the rock crusher. It should, of course, be clear that regardless of the number of exit openings used, the openings are preferably to be equally spaced about sidewall 112.

Means for defining a lip is provided adjacent each opening 116 in the form of an elongated lip member 124. A generally right-angled bend is provided near one end of lip member 124 so as to define a lip surface 126 and an end face 128. A curved bend 130 is provided in lip member 124 near its opposite end, providing a means for retaining the lip member 124 within the impeller assembly 30. As seen in FIG. 10, lip member 124 is of a height substantially equal to the height of each opening 116.

Referring back to FIG. 2, an upper support block 132 is secured to the upper plate 108 near each opening 116 and has a vertical bore for passage of a removable drop pin 136. A lower support block **132*a* of like configuration, but with no pin passage, is secured to lower plate 110. Upper and lower support blocks 132 and 132*a* are mounted in mutual vertical alignment and are each of a height such that the space defined therebetween is of height equal to that of opening 116 and is positioned with respect to sidewall 112 at a height identical to opening 116. A removable cylindrical drop pin 134 passes through upper plate 108 and upper and lower support blocks 132, 132*a* and, the vertical curved bend 130 of lip body 124 is engageable with pin 134 so that lip body 124 may be secured within impeller assembly 30 by engagement with pin 134. In addition, lip body 124 is placed adjacent the side edge of opening 116. As impeller assembly 30 is rotated, centrifugal forces will operate to hold lip body 124 firmly in position. Of course, it will be recognized that other means for securing lip body 124 may be used in place of pin 134**, such as fixed abutments or pins of other cross-sectional shape.

Each removable pin 136, which may be formed from a bolt, extends downwardly from the upper support block 132 along an upper portion of the height of lip body 124 so as to retain lip bodies 124 in proper position around and against the pins 134 at all times.

Referring to FIG. 5, lower impeller plate 110 is secured to a central circular block 138 having a central opening for passage therethrough of drive shaft 34. Circular block 138 carries thereon landing surface 114, including a landing cone 140 which is disposed concentrically within an annular ring 142. Landing cone 140 and landing ring 142 cooperate to define the conical landing surface 114 and are positioned directly beneath feed tube 18 through which the rock to be crushed in delivered onto the landing surface 114. Landing cone 140 includes a central recess for containing attachment means to the upper portion of drive shaft 34 for rotation of impeller assembly 30.

An entrance ring 144 is attached to upper plate 108 and defines an annular opening 146, with ring 144 encircling the lower end of feed tube 18. Ring 144 serves to provide a replaceable inner edge for upper plate 108 and to restrict air flow through the gap around the feed tube 18 at its entrance to the impeller by trapping fine particles within the gap to the extent that the particles form a seal. As these particles build up, they tend to abrasively wear away the lower portion of feed tube 18. Accordingly, a keyway is formed within the exterior surface of feed tube 18 extending partially upward from its lower end. A key 148, formed of a hard material, such as tungsten carbide, is fitted within the keyway and acts as a scraper to keep dust accumulated between entrance ring 144 and feed tube 18 from contacting the surface of feed tube 18. Of course, more than one such key 148 may be provided around the exterior of feed tube 18.

A vertical baffle 150 is mounted within the impeller interior, by means which will be described below, and extends radially inwardly from the impeller sidewall 112. As seen in FIG. 2, each baffle 150 is located adjacent the side edge of each opening 116 that is opposite the side edge against which a lip body 124 is positioned. As impeller assembly 30 is rotated to hurl rock through exit openings 116 to the impact surface, a certain portion of the rock will be retained within impeller assembly 30 through the action of sidewall 112, lip bodies 124, and baffles 150. Thus, as shown in FIG. 2, operation of impeller assembly 30 will cause accumulation of trapped rock in the configuration generally indicated as 152. Each accumulation 152 extends from the outer edge of lip surface 126 to a relatively well-defined apex 154, and then extends in a trailing direction to baffle 150. A rock being delivered to landing surface 114 is accelerated by impeller assembly 30, it will be driven against one of the rock accumulations 152 between apex 154 and lip surface 126. The rock will then be accelerated along the rock face defined by rock accumulation 152, after which it will be thrown from impeller assembly 30 through opening 116.

In order to reduce the weight of the impeller caused by the accumulated rock, thereby facilitating its rotation, a molded rubber block 156 may be placed within the impeller assembly against sidewall 112 between each baffle 150 and mounting block 132. Since rubber block 156 will occupy a portion of the space within which rock will normally accumulate, the amount of accumulated rock can be reduced without affecting the shielding effects of the accumulation. Each block 156 is provided with a bore extending therethrough, through which a bolt 158 extends to connect upper plate 108 with lower plate 110 for holding the impeller assembly 30 together. Referring back to FIG. 5, in which rubber block 156 is not shown, bolt 158 passes through a sleeve 160 positioned between upper plate 108 and lower plate 110 so that bolt 158 is protected from accumulated rock in the event rubber blocks 156 are not used.

When used, the molded rubber blocks 156 not only reduce the impeller weight, but also reduce unbalance from unequal weights of rock accumulations, reduce the mass movement of inertia due to rock accumulations, facilitate removal of rock accumulations by reducing the quantity of rock, and by providing a soft, resilient core for each accumulation that will allow a hard packed shell of rock to be cracked away more easily, and facilitate removal of the lip members 124 by providing a soft, resilient core for each accumulation that will allow the hard pack shell of rock inward of each lip member to be cracked away more easily before disengaging the lip members from retaining pins 134.

It should be recognized that the general path for accelerated rock described above holds true regardless of whether the pathway is defined by a rock accumulation or by structural members within the impeller assembly. Thus, by providing lip bodies 124, the abrasive forces of the rock are largely imposed upon the face of rock accumulation 152 rather than impeller assembly 30. Consequently, a significant portion of wear within impeller assembly 30 is eliminated.

Notwithstanding the foregoing, a small but significant portion of the rock traverses the face of rock accumulation 152 at its upper or lower edge, or moves toward opening 116 along the upper or lower impeller surface at a distance slightly away from the rock face. This can cause significant wear upon the impeller structure near the upper and lower edges of the rock face. As a result, many impellers utilize wear plates to protect these surfaces, such wear plates requiring periodical replacement.

In the present invention, wear plates are also utilized to protect these surfaces, with the specific wear plates used incorporating a substantial improvement. As shown in FIG. 2, a plurality of two different types of wear plates are provided along lower impeller plate 110. Identical wear plates are positioned along upper plate 108, except that they are of opposite hand.

Upper and lower wear plates 162 of opposite hand comprise the first type of wear plates utilized within the present invention and are shown in detail in FIGS. 3, 6 and 7. Each wear plate 162 is provided with a surface 164 which depending upon whether wear plate 162 is carried on lower plate 110 or upper plate 108, forms a portion of the upper or lower working surface of the interior of impeller assembly 30. Each wear plate 162 is cast from alloy abrasion-resistant white cast iron and is provided with a plurality of recesses 166 along its underside to reduce the weight of the wear plate and the material required for its fabrication. Lead may be added within the recesses of the wear plates for balancing the weights of the wear plates to a standard. A flagne 168 is provided at one end of each wear plate 162 so that, as best shown in FIG. 5, flange 168 of the lower wear plates can be placed beneath ladning ring 142 and flange 168 of the upper wear plates can be located above the entrance ring 144 to secure the wear plates 162 within the impeller interior.

Lugs 170–171 project from wear plate surfaces 164 and, as shown in FIGS. 2 and 5, form a portion of the means for retaining each baffle 150 in position. Completing the retaining means is a bar 172 attached to the sidewall 112, extending nearly the full height of baffle 150. In addition to retaining baffle 150 in place, bar 172 additionally serves to secure wear plates 162 in position. When rubber blocks 146 are used, bar 172 may be dispensed with, block 156 being formed to abut against the side of baffle 150. In addition, block 156 can serve to hold wear plates 162 in place.

Since wear plates 162 are outside the general pathway for movement of rock to be crushed from landing surface 114 to openings 116, wear plates 162 will be subject to relatively little wear. Accordingly, these wear plates will require relatively infrequent replacement.

Alternating with wear plates 162 around both upper and lower plates 108 and 110 are wear plates 174, which are shown in detail in FIGS. 4, 8 and 9. Wear plate 174 include a flat working surface 176 and are cast from alloy abrasion-resistant white cast iron. Recesses 178 are formed in the underside of wear plate 174 for the same purpose as recesses 166 in wear plates 162. A flange 180 is provided so that, in a manner similar to wear plates 162, wear plates 174 can be secured within the interior of impeller assembly 30 by placement of flange 180 beneath either landing ring 142 or entrance ring 144. Each wear plate 174 cooperates with an adjacent wear plate 162, as shown in FIG. 2, to form a contiguous surface between each opening 116 and landing surface 114. A recess or step defined by a curved ledge 181 is formed opposite the side wall 12. This ledge 181 is sloped and mates with an insert **112*a* of triangular cross-section welded to the inner face of the cylindrical side wall 112 as shown in FIG. 10. This arrangement serves to retain wear plates 174 in proper position with respect to the cylindrical side wall 112, and the mating conical shapes of the ledge 181 and inserts 112***a* facilitate removal of the wear plates 174 permitting them to be tilted during removal.

A recess 182, defined by a generally vertical ledge 183, is formed within the working face of each wear plate 174. As can be seen in FIG. 2, recess 182 is formed so that it is positioned beneath accumulation 152 and extends beyond the edge of the face thereof to slightly away from the rock accumulation. During rotation of impeller assembly 30, the exposed portion of recess 182 beyond the accumulation face will collect rock particles and will fill with such particles to form substantially a flat surface that is contiguous with surface 176 of wear plate 174. Consequently, as rock moves along the upper or lower edges of the accumulation face, or along wear plate 174 slightly away from the face, the rock will traverse along the rock trapped within recess 182 rather than the metal of the wear plate 174. Accordingly, wear upon surface 176 of the wear plate is avoided. The ledge 183 defining the recess 182 may have a curve parallel to the rock accumulation face, but preferably will be curved such as to converge slightly with the rock accumulation face going in the outward direction away from the center.

It should be recognized that the recesses 182 formed in wear plates 174 carried on upper plate 108 will function identically to those of the wear plates carried on lower plate 108. Because of the very high centrifugal forces placed upon the rock material by rotation of impeller assembly 30, rock will be retained within recesses 182 even along the upper surface of the impeller interior.

The preferred shape for recess 182 is curved as previously indicated. However, it should be recognized that the vertical ledge 183 defining recess 182 may lie along a straight line rather than a curved line. Alternatively, an approximation to the curve of the rock accumulation face consisting of a few straight lines may also be used. What is important is that pebbles be trapped within the recess 182 in the region of the intersection of the accumulation face with the surface defined by the wear plates. These trapped pebbles will normally protrude beyond surface 176 of wear plates 174 and thereby diminish contact of rock flowing toward discharge openings 116 with the portion of surface 176 lying generally radially outward from the recess 182. As a result, wear is reduced on surface 176.

It should be noted at this point that it has been found that, depending upon the particular rock being used within the crusher, the size and shape of the rock particles, and the moisture content, the exact configuration of rock accumulatoin 152 and the exact location of its apex 154 will vary. Since the proper position and shape of recesses 182 depend upon the position and shape of the faces of accumulations 152, it may well be necessary to provide several versions of wear plates 174 with different configurations for recess 182. It may then be necessary to change the wear plates 174 at the time a change in the rock to be crushed is made. For similar reasons, it may be necessary to provide a variety of sizes of baffles 150 and of lip members 124.

Referring to FIG. 2, 5 and 10, it can be seen that wear plates 162 and 174 are constructed to extend over sidewall 112 and wear ring 120 at each opening 116. Thus, any wear along the upper and lower opening edges caused by rock moving outwardly through openings 116 does not affect the sidewall or wear ring, but will affect only the replaceable wear plates.

It will be seen from reference to FIG. 2 that end surface 128 of lip body 124 will be subject to wear since the rock will traverse end surface 128 after leaving the side face of rock accumulation 152. Due to the presence of rock material against lip surface 126, however, wear on end surface 128 will tend toward the outer edge of the surface. Thus, the corner formed by lip surface 126 and end surface 128 will be preserved for a relatively long period, ensuring continued presence of rock accumulations 152. To provide for increased life for end surfaces 128, an insert 184 formed from a hard material, such as tungsten carbide, is embedded within the end of lip body 124. The insert 184 provides a working surface that is flush with end surface 128 so that there is not effect upon the path of rock being thrown from impeller assembly 30. Also, by having the tungsten carbide working surface flush with end surface 128, the brittle corners of the tungsten carbide are supported by the surrounding material, which avoids early breakage of these corners and provides longer life.

Similarly, some small portion of the rock which has moved from landing surface 114 along the rock retained within recesses 182 will pass through opening 116 along the surface of wear plate 174 in the vicinity of end face 128 of lip body 124. To help preserve this surface, a recess 186 may be formed in wear plate 174 to hold an optional insert 188, formed from a hard material such as tungsten carbide. As with insert 184, insert 188 is embedded to provide a working surface flush with surface 176 of wear plate 174. Inserts may be provided in the wear plates 174 along both the upper and lower surfaces of the impeller interior so that inserts 188 cooperate with insert 184 to provide a C-shaped working surface of tungsten carbide.

While the form of apparatus herein described constitutes a preferred embodiment of the invention, it is to be understood that the invention is not limited to this precise form of apparatus and that changes may be made therein without departin from the scope of the invention.

I claim:

1. An impeller for use in a centrifugal impact rock crusher, said crusher having a cylindrical housing with a vertically disposed central axis and an interior, means defining an impact surface positioned radially around the interior of said housing and transverse to said central axis, impeller mounting means for mounting said impeller concentrically within said housing and for rotating said impeller about said axis, and feed means for feeding rock to be crushed to said impeller, said impeller comprising:

upper and lower cover plates, said lower cover plate being connected to said impeller mounting means and said upper cover plate defining an opening concentric with said axis for receiving rock to be crushed into said impeller;

means defining a landing surface carried upon said lower cover plate concentrically with said axis for impingement thereon of rock being fed to said impeller by said feed means;

a generally cylindrical sidewall between said upper and lower cover plate concentricall with a plurality of exit openings in an equally spaced relationship along said sidewall, each of said openings having two opposite side edges and a top edge and bottom edge between said side edges;

rock retaining means connected to at least one of said cover plates and said sidewall and adjacent to one of said side edges of each of said openings for retaining a portion of rock to be crushed as an accumulation within said impeller in response to rotation thereof, said retaining means being adapted to create and accumulation of such rock at each of said openings, wherein each of said accumulations will include a relatively well-defined accumulation face, rotation of said impeller causing rock to move generally along said accumulation faces as said rock is thrown through said openings; and a plurality of wear plates carried on said upper and lower cover plates and covering said top and bottom edges of said exit openings, each of said wear plates having a wear plate surface extending outwardly from said landing surface away from said central axis, having an outermost edge, and being connected to one of said cover plates such that one of said accumulation faces will intersect at least one of said wear plates at a respective intersection, each at least one of said wear plates defining a recess along said intersection which extends into said wear plate surface of each of said at least one of said wear plates to a level below the level of the outermost edge of said at least one of said wear plates and away from the location of the respective accumulation face along at least a portion thereof, said recess extending outwardly relative to the landing surface and being adapted to retain therein a portion of rock to be crushed whereby the recess comprises part of the rock retaining means.

2. An impeller as defined in claim 1 wherein each of said recesses within each of said wear plates is arranged to extend at least partially beneath the one of said accumulations having said face intersecting therewith.

3. An impeller as defined in claim 1 wherein each of said recesses extends into said surface of the respective wear plate an amount substantially equidistant from the respective said accumulation face.

4. An impeller as defined in claim 1 wherein each of said recesses within each of said wear plates is defined by a generally vertical ledge, said ledge being defined by a curve which extends from the landing surface toward an exit opening and is generally parallel to the respective said accumulation face.

5. An impeller as defined in claim 4 in which said curve converges slightly, with the accumulation face going in the outward direction away from said center axis.

6. An impeller as defined in claim 1 wherein each of said recesses within each of said wear plates is defined by a generally vertical ledge, said ledge being defined by at least one straight line remote from the respective accumulation face.

7. An impeller as defined in claim 1 wherein said retaining means includes a lip means disposed at each of said openings adjacent one of said side edges thereof, each of said lip means defining a lip surface extending substantially the full height of said opening and directed generally inwardly with respect to said impeller for facilitating retention of rock.

8. An impeller as defined in claim 7 wherein each of said wear plates includes an insert embedded therein and flush with the wear plate surface, said insert being disposed along said wear plate surface adjacent said lip surface and remote from said recess.

9. An impeller for use in a centrifugal impact rock crusher, said crusher having a cylindrical housing with a vertically disposed central axis and an interior, means defining an impact surface positioned radially around the interior of said housing and transverse to said central axis, impeller mounting means for mounting said impeller concentrically within said housing and for rotating said impeller about said axis, and feed means for feedin rock to be crushed to said impeller, said impeller comprising:

upper and lower cover plates, said lower cover plate being connected to said impeller mounting means and said upper cover plate defining an opening concentric with said axis for receiving rock to be crushed into said impeller;

means defining a landing surface carried upon said lower cover plate concentrically with said axis for impingement thereon of rock being fed to said impeller by said feed means;

a generally cylindrical sidewall between said upper and lower cover plates and defining therein a plurality of exit openings in an equally spaced relationship along said sidewall, each of said openings having two opposing side edges and a top edge and bottom edge between said side edges;

rock retaining means connected to at least one of said cover plates and said sidewall and adjacent to one of said side edges of each of said openings for retaining a portion of rock to be crushed as an accumulation within said impeller in response to rotation thereof, said retaining means being adapted to create an accumulation of such rock at each of said openings, wherein each of said accumulations will include a relatively well-defined accumulation face, rotation of said impeller causing rock to move generally along said accumulation faces as said rock is thrown through said openings; and varieties of wear plates adapted to be mounted on said upper and lower cover plates and cover said top and bottom edges of said exit openings, each of said wear plates having a wear plate surface extending outwardly from said landing surface away from said central axis, having an outermost edge, and being selectively connected to one of said cover plates such that one of said accumulation faces will intersect at least one of said wear plates at an intersection location, said wear plate at least one of said wear plates defining a recess along the intersection location, said recess extending into said wear plate surface of said at least one of said wear plates to a level below the level of said outermost edge of said at least one of said wear plates and away from said intersection location along at least a portion of said face, said recess extending outwardly relative to the landing surface and being adapted to retain therein a portion of rock to be crushed whereby the recess comprises part of said rock retaining means;

said varieties of wear plates differing from each other in the shape of the recess, said shapes being determined by the characteristics of types of rock to be crushed, selection of the specific one of said varieties for connection to said cover plates being determined by the type of rock to be crushed.

10. An impeller as defined in claim 9 wherein said shape of each of said recesses within each of said wear plates is defined by a generally vertical ledge, said ledge being defined by a curve generally parallel to said intersection location, the configuration of the face of each rock accumulation being determined by the type of rock to be crushed.

11. An impeller for use in a centrifugal impact rock crusher, said crusher having a cylindrical housing with a vertically disposed central axis and an interior, means defining an impact surface positioned radially around the interior of said housing and transverse to said central axis, impeller mounting means for mounting said impeller concentrically within said housing and for rotating said impeller about said axis, and feed means for feeding rock to be crushed to said impeller, said impeller comprising:

upper and lower cover plates, said lower cover plate being connected to said impeller mounting means and said upper cover plate defining an opening concentric with said axis for receiving rock to be crushed into said impeller;

means defining a landing surface carried upon said lower cover plate concentrically with said axis for impingement thereon of rock being fed to said impeller by said feed means;

a generally cylindrical sidewall connecting said upper and lower cover plates and defining therein a plurality of exit openings in an equally spaced relationship along said sidewall, each of said openings having opposing first and second side edges and a top edge and bottom edge between said side edges;

rock retaining means connected to at least one of said cover plates and said sidewall adjacently said first side edge of each of said openings for retaining a portion of rock to be crushed as an accumulation within said impeller in response to rotation thereof, said retaining means being adapted to create an accumulation of such rock at each of said openings, wherein each of said accumulations will include a relatively well-defined accumulation face, rotation of said impeller causing rock to move generally along said accumulation faces as said rock is thrown through said openings; and a plurality of first and second wear plates carried on said cover plates and covering said top and bottom edges of said exit openings, each of said first and second wear plates having a wear plate surface continuing from said landing surface, having an outermost edge, and being connected in alternating fashion to one of said cover plates such that one of said first wear plates and one of said second wear plates extend into each of said openings, each said first wear plate extending into said opening adjacent to a said first side edge so as to be intersected by an accumulation face at a respective intersection, said second wear plates extending into said opening adjacent a said second side edges;

each said first wear plate defining a recess along the respective said intersection which extends into each said first wear plate surface to a level below the level of said outermost edge of each said first wear plate and extends away from said intersection along at least a portion thereof, said recess extending outwardly relative to the landing surface and being adapted to retain therein a portion of the rock to be crushed whereby the recess comprises part of the rock retaining means.

12. An impeller as defined in claim 11 wherein said retaining means further includes a baffle disposed adjacent said sidewalls at each of said second side edges of each of said openings and extending radially inwardly therefrom, each of said baffles extending from one of said second wear plates carried on said lower plate to one of said second wear plates carried on said upper plate, each of said second wear plates including means for securing one of said baffles.

13. An impeller assembly for use in a centrifugal impact rock crusher, comprising:

a rotatable cylindrical impeller housing with a vertically disposed central rotary axis, said housing having an upper impeller unit which has a feed opening disposed coaxially with said housing for receiving rock, said housing also having a lower impeller unit which has a landing surface disposed coaxially with said housing for impingement on said landing surface of rock being fed through said feed opening, said impeller units being connected to each other by a generally cylindrical side wall unit which has a plurality of exit openings spaced around said side wall unit, each of said exit openings having an upper opening edge, a bottom opening edge, and two opposing first and second side opening edges, wherein rotation of the impeller housing about said axis defines the first of said side opening edges of each of said exit openigns as a forward side edge and the second of said side edges of each of said exit openings as a rearward side edge with respect to the direction of rotation of the impeller housing;

rock retaining means connected to at least one of said impeller units and said sidewall and adjacnet to one of said side edges of each of said exit openings for retaining a portion of rock to be crushed as an accumulation wihtin said impeller in response to rotation thereof, said retaining means being adapted to create and accumulation of such rock at each of said exit openings, wherein each of said accumulations will include a relatively well-defined accumulation face, rotation of said impeller causing rock to move generally along said accumulation faces as said rock is thrown through said exit openings;

said rock retaining means including lip members disposed within said exit openings adjacent the second side edge thereof and extending substantially the full height of the exit openings, each lip member extending inwardly with respect to said cylindrical side wall unit from a respective exit opening and being shaped for facilitating retention of a portion of rock to be crushed to thereby protect the second side edge of each exit opening;

mounting means for said lip members extending between said upper and lower impeller units and interfitting with said lip members near said side wall unit; and a plurality of top and bottom wear plates carried on said upper and lower impeller units, respectively, each of said wear plates having a wear plate surface extending outwardly from said landing surface away from said central axis having an external edge, and being connected to one of said cover plates such that one of said accumulation faces will intersect said wear plate at a respective intersection, the wear plate surfaces of said bottom wear plates being at a level above the level of said bottom edges and adjacent thereto, each said bottom wear plate defining a recess along said intersection which extends into its wear plate surface below the level of its outermost edge and away from the location of the respective accumulation face along at least a portion thereof, said recess extending upwardly away from the landing surface and being adapted to retain therein a portion of rock to be crushed whereby the recess comprises part of said rock retaining means.

14. An impeller assemlby according to claim 1 in which said plurality of wear plates comprises a plurality of first and second wear plates each having a wear plate surface extending outwardly from said landing surface, said first and second wear plates being connected in alternating fashion to one of said impeller untis such that one of said first wear plates and one of said second wear plates extend into each of said exit openings, said first wear plates each defining a said recess and said second wear plates extending into said exit openings adjacent said first side opening edges of the exit openings.

* * * * *

UNITED STATES PATENT AND TRADEMARK OFFICE

CERTIFICATE OF CORRECTION

PATENT NO. : 4,796,822

DATED : January 10, 1989

INVENTOR(S) : Gabriel M. Terrenzio

It is certified that error appears in the above-identified patent and that said Letters Patent is hereby corrected as shown below:

In claim 1, column 10, line 64, delete "plate concentricall" and substitute therefor --plates and formed--.

In claim 1, line 67, delete "opposite" and substitute therefor --opposing--.

In claim 9, column 12, line 9, delete "feedin" and substitute therefor --feeding--.

In claim 11, column 13, line 42, delete "cover plates" and substitute therefor --lower and upper cover plates respectively--.

In claim 11, line 53, delete "plates" and substitute therefor --plate--.

In claim 12, column 13, line 67, delete "sidewalls" and substitute therefor --sidewall--.

In claim 13, column 14, line 24, delete "openigns" and substitute therefor --openings--.

UNITED STATES PATENT AND TRADEMARK OFFICE

CERTIFICATE OF CORRECTION

PATENT NO. : 4,796,822

DATED : January 10, 1989

INVENTOR(S) : Gabriel M. Terrenzio

It is certified that error appears in the above-identified patent and that said Letters Patent is hereby corrected as shown below:

In claim 13, line 30, delete "adjacnet" and substitute therefor --adjacent--.

In claim 13, line 33, delete "wihtin" and substitute therefor --within--.

In claim 13, line 59, delete "external" and substitute therefor --outermost--.

In claim 13, column 15, line 3, delete "upwardly" and substitute therefor --outwardly--.

In claim 14, column 15, line 7, delete "assemlby" and substitute therefor --assembly-- , and change the dependency from claim 1 to claim 13.

In claim 14, column 16, line 2, delete "untis" and substitute therefor --units--.

Signed and Sealed this

Twenty-fifth Day of July, 1989

*Attest:*

*Attesting Officer*

DONALD J. QUIGG

*Commissioner of Patents and Trademarks*